United States Patent [19]

Thompson

[11] 4,453,047

[45] Jun. 5, 1984

[54] SPEAKER MOUNTING BRACKET

[76] Inventor: Arthur M. Thompson, 12 Waterside Ave., Northport, N.Y. 11768

[21] Appl. No.: 427,079

[22] Filed: Sep. 29, 1982

[51] Int. Cl.[3] ..... H04R 1/02; H04R 1/20

[52] U.S. Cl. ..... 179/146 R; 179/146 E; 181/150; 181/199; 248/293; 312/7.1

[58] Field of Search ..... 179/146 E, 146 R; 381/86, 87, 88, 89, 90; 181/148, 150, 199; 248/293; 312/7.1

[56] References Cited

U.S. PATENT DOCUMENTS

| | | | |
|---|---|---|---|
| 3,680,936 | 8/1972 | Backhaus | 312/7.1 |
| 4,014,597 | 3/1977 | Griffin | 179/146 E |
| 4,031,318 | 6/1977 | Pitre | 181/148 |

FOREIGN PATENT DOCUMENTS

| | | | |
|---|---|---|---|
| 2824522 | 12/1979 | Fed. Rep. of Germany | 381/88 |

*Primary Examiner*—Harold I. Pitts

*Assistant Examiner*—Danita R. Byrd

*Attorney, Agent, or Firm*—Sprung, HOrn, Kramer & Woods

[57] ABSTRACT

A speaker bracket comprises a first planar apertured mounting frame to which a speaker is fixedly connected with the aperture thereof aligned with the speaker diaphragm and a second planar apertured mounting frame fixedly connected to a planar mounting surface; in particular the rear deck of an automobile. The two frames are hinged together at one edge of each to permit pivotal movement of the two frames from a closed position wherein the two frames are substantially parallel with aligned apertures to an open position wherein the two frames are substantially perpendicular and the frames are releasably locked in the closed position. The mounted speaker can then be dropped into open position to face the trunk of an automobile so then when the trunk is opened the sound from the speakers can be clearly heard outside of the automobile.

5 Claims, 8 Drawing Figures

SPEAKER MOUNTING BRACKET

BACKGROUND OF THE INVENTION

The present invention relates to a mounting bracket for speakers and especially speakers mounted in the rear of automobiles.

In conventional automobile sound system, two speakers are statically mounted at the front of the car and two speakers are statically mounted at the rear of the car, usually below the rear deck or package shelf.

When one is at the beach, on a picnic or working in the outdoors near one's car, it is often desirable to be able to listen to the car's audio system. A common practice is to turn the sound system on and open the trunk of the car so that sound emanating from the speakers within the car will travel outside the car. Alternatively, one could open the car doors or windows in order to listen to the car sound system.

While the above-mentioned alternative measures make it possible to hear the automotive audio system, due to the positioning of the speakers the stereophonic aspects of the music are lost and at best the sound that is heard is muffled or out of phase.

The only satisfactory solution to the problem has been to provide speakers which can be physically removed from inside the car and placed outside of the car, however this system has proven to be costly and is prone to mechanical or electrical failure.

SUMMARY OF THE INVENTION

The main object of the present invention is to overcome the disadvantages of the prior art speaker mounting devices and to provide a speaker mounting bracket which enables one to hear an automotive audio system mounted interior of the automobile when one is outside of the automobile.

These and other objects of the present invention are provided in accordance with the present invention by a speaker mounting bracket which includes a first planar apertured mounting frame having means for fixedly connecting a speaker thereto with the aperture thereof aligned with the speaker diaphragm, a second planar apertured mounting frame having means for fixedly connecting same to a planar mounting surface, means hingedly connecting the two frames together at one edge of each to permit pivotal movement of the two frames from a closed position wherein the two frames are spaced apart and substantially parallel with their apertures aligned, to an open position wherein the two frames are substantially perpendicular and means for releasably locking the two frames in the closed position.

In particularly advantageous embodiment of the invention, the speaker bracket in accordance with the invention is mounted at the rear deck of an automobile, with the first mounting frame connected to a speaker and the second mounting frame fastened below the deck. During normal use, the two frames are locked in the closed position so that sound emanating from the speakers enters the interior of the car. When it is desired to listen to the sound system outside of the car, the releasable locking means is released, enabling the first mounting frame and the speaker connected thereto to pivot to the open position wherein it will be perpendicular to the second mounting frame and therefore the rear mounting deck of the automobile and facing towards the rear of the car, i.e. the trunk. If the trunk is now opened, one will be able to clearly hear sound emanating from the speakers and directed outwardly of the car.

The speaker bracket in accordance with the invention is constructed so as to be retrofitted to already existing speaker mounts and is of a simple construction so as to enable easy installation and use.

In a preferred embodiment of the invention, the releasable locking means comprises a slidable pin which can be slid longitudinally into and out of a locking collar to hold the speaker in the closed position.

These and other objects and advantages of the present invention will become evident when the present invention is described by way of example with reference to the following detailed description of the invention and the attached drawings wherein:

DETAILED DESCRIPTION OF THE INVENTION

Figure 1:
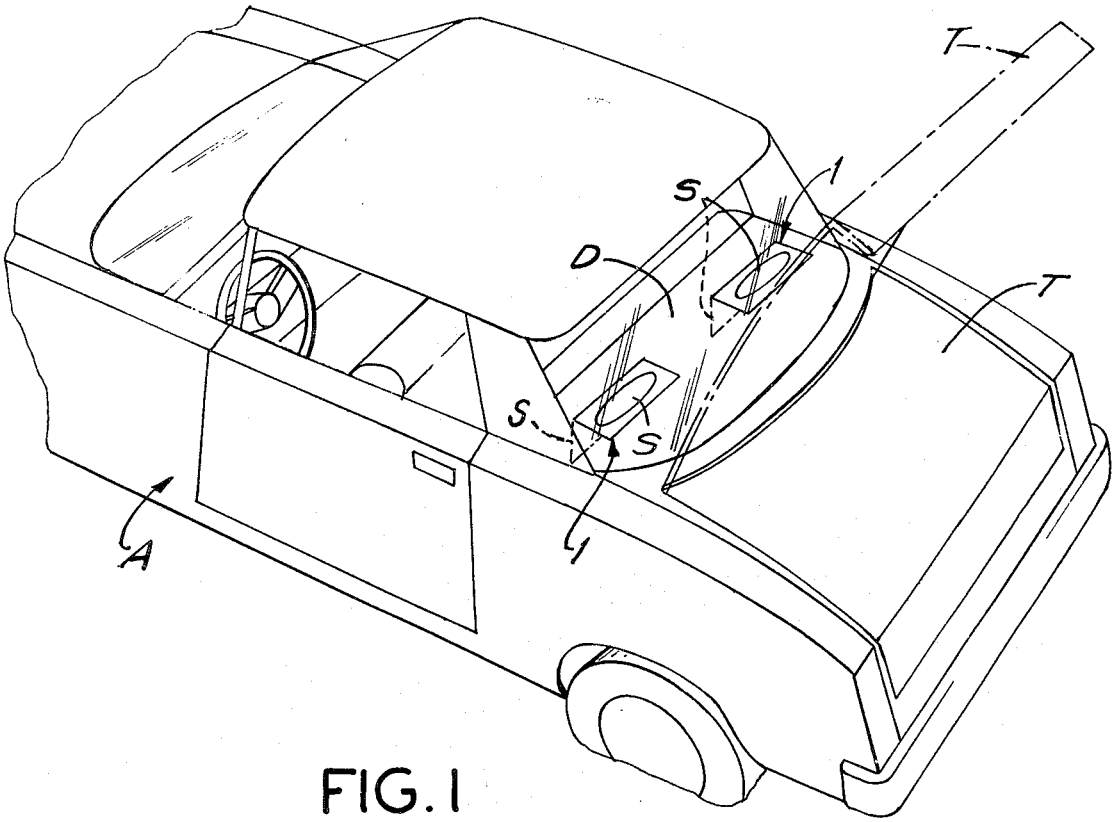
FIG. 1 is a schematic view of the mounting bracket according to the invention in use in an automobile.
Figure 2A:
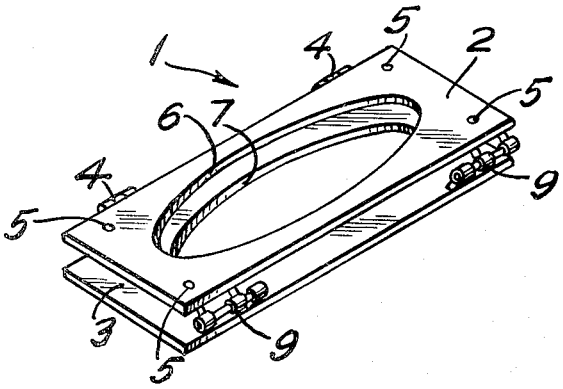
FIGS. 2*a* and 2*b* show the speaker bracket in the closed and open positions respectively.
Figure 2B:
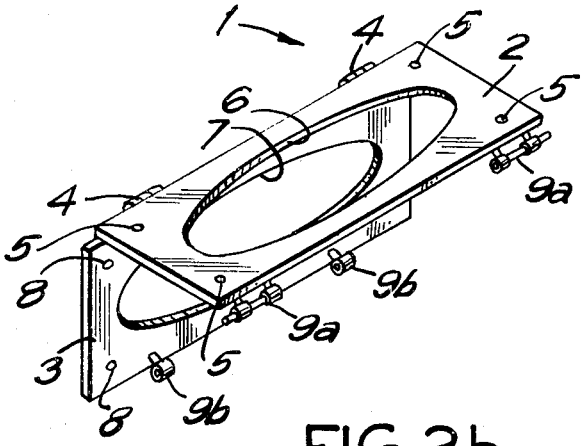

The speaker mounting bracket 1 according to the present invention is shown in its basic form in FIGS. 2*a* and 2*b* and shown in use in FIG. 1. The bracket 1 includes planar frames 2 and 3, each having a substantially central aperture 6, 7 and mounting holes 5, 8 therein. The two frames 2, 3 are pivotally connected together by means of a conventional hinge connection 4 which enables pivotal movement of the frames from the closed position shown in FIG. 2*a* wherein frames 2 and 3 are parallel and spaced apart approximately ½" with their apertures 6, 7 aligned and the open position shown in FIG. 2*b* wherein frames 2 and 3 are perpendicular.

The mounting bracket 1 also includes the releasable locking means 9, which in the embodiment shown has the portion 9*a* thereof mounted on frame 2 and the portion 9*b* thereof mounted on frame 3.

Figure 6A:
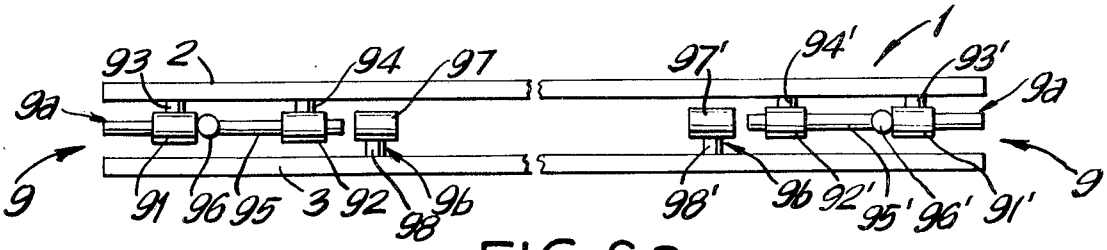
FIGS. 6*a* and 6*b* are detailed views of the releasable locking means in the unlocked and locked positions.
Figure 6B:
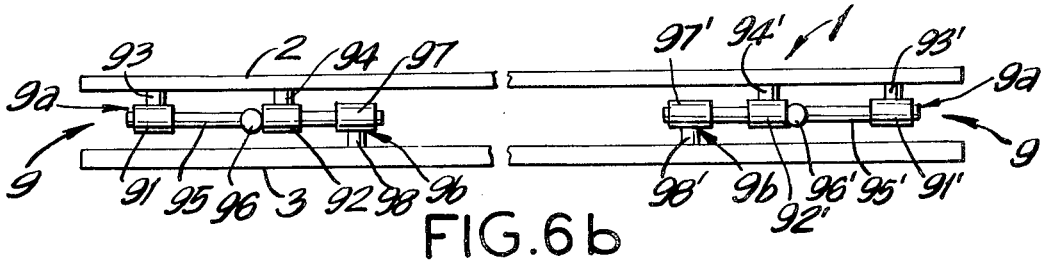

FIGS. 6*a* and 6*b* show the structures of the releasable locking means 9 in more detail. As shown therein, the releasable locking means includes at least one lock having elements 91–98 and preferably includes two locks including elements 91–98 and 91'–98'. For convenience of explanation, only one lock will be described since both operate in a similar manner.

Lock portion 9*a* attached to frame 2 includes two spaced apart cylindrical collars 91, 92 having cylindrical bores therein so as to slidably receive a cylindrical pin 95 therein. The collars 91, 92 are connected to frame 2 by means of connecting members 93, 94 respectively. The pin 95 includes a perpendicularly extending projection 96 which is disposed between the two collars 91 and 92 so as to enable the pin 95 to be longitudinally slid while at the same time preventing the inadvertent removal of the pin from the collars. The collars 91 and 92 are connected to frame 2 in such a manner that the pin 95 is disposed parallel to the pivot axis of hinge 4 and preferably parallel to edge 2*a*.

The lock portion 9*b* connected to frame 3 includes a cylindrical collar 97 having a cylindrical bore therein and connected via member 98 to frame 3. The collar 97 is disposed so as to be aligned with pin 95 whereby the longitudinal sliding of pin 95 from the position shown in FIG. 6*a* enables end portion 95*a* to be received within collar 97 as shown in FIG. 6*b*. Thus FIG. 6*a* shows the unlocked position of the releasable locking means 9 while FIG. 6*b* shows the locked position of releasable locking means 9.

The connecting members 93, 94 and 98 are disposed so as to position frame 3 parallel to frame 2 and spaced apart therefrom when the frames are in the closed position shown in FIG. 2*a*.

FIGS. 1 and 3–5 show the mounting of the speaker mounting bracket in an automobile in a preferred embodiment of the present invention. As shown in FIG. 1, the automobile A has a rear package shelf or deck D where speakers S are normally mounted. The rear deck D is adjacent to the trunk of the car whose trunk door T is shown in the closed position in solid lines and in the open position in dotted lines.

Figure 3:
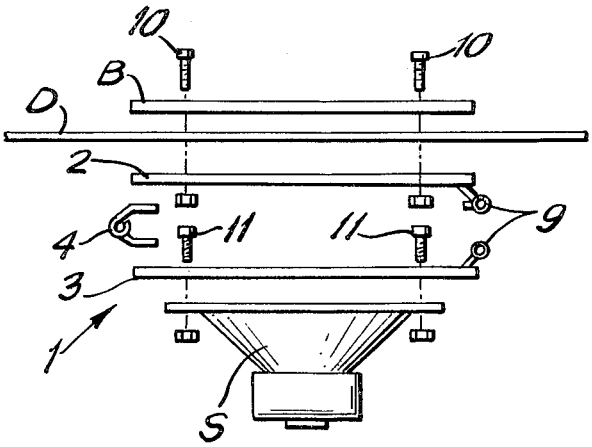
FIG. 3 is an exploded side view of the speaker bracket when mounted in place in the closed position.

As shown in FIG. 3, the mounting bracket 1 can be utilized with conventional static speaker mounting brackets B so as to retrofit an already existing speaker mounting. As shown, the speaker S which is already attached to the rear deck D via bracket B is removed and the mounting bracket of the present invention is inserted therebetween as shown. Frame 2 is connected to deck D and speaker bracket B via fasteners 10 which are disposed through mounting holes 5 therein. The speaker mounting bracket 1 according to the invention is disposed so that the hinge connection 4 faces the front of the automobile while the locking means 9 faces the rear.

The speaker S is connected to frame 3 via screw fastening elements 11 and speaker mounting holes 8 in frame 3. The apertures 6 and 7 of frames 2 and 3 are dimensioned so as to be slightly smaller than conventional speaker diaphragm while the frames are dimensioned to be slightly larger so as to accommodate different size speakers. Moreover, additional mounting holes other than those shown in FIGS. 2*a* and 2*b* can be included so as to make the bracket acording to the present invention universally adaptable to the most popular brands of speakers. Of course, the mounting bracket according to the invention can be customized for a particular type of speaker with the apertures 6 and 7 and the mounting holes 5 and 10 being disposed in only the precise locations for a particular speaker.

In normal use, the speaker is locked in the closed position shown in FIG. 3 so that sound emanating therefrom travels through the deck in the usual manner and into the interior of the automobile. When it is desired to listen to the automobile sound system outside of the automobile, one merely has to unlock the releasable locking means by moving member 96 to the left and member 96′ to the right (from the position shown in FIG. 6*b* to the position shown in 6*a*) whereupon the mounting bracket will drop to the position shown in FIG. 4. If the trunk cover T is then moved to the position shown in dotted lines in FIG. 1, the speakers as shown in dotted lines in FIG. 1 will be directed towards the outside and one would be able to listen to the automobile sound system in an improved and desirable manner.

In order to return the mounting bracket to its original position, one merely has to pivot the frame 3 back to the closed position and lock the releasable locking means 9 as shown in FIG. 6*b*.

The frames 2 and 3 are preferably integral one piece members and are composed of a metal such as aluminum or steel.

Figure 5:
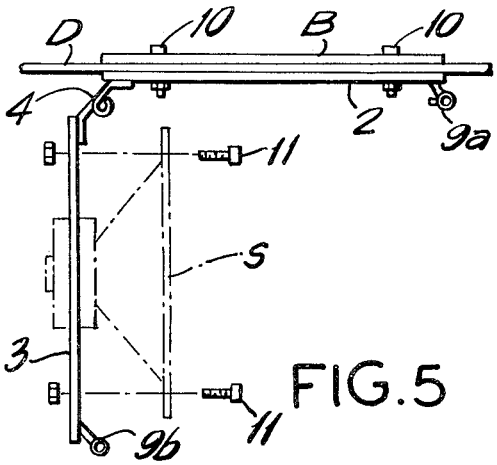
FIG. 5 is a side view of an alternative mounting of the speaker in the speaker bracket.
Figure 4:
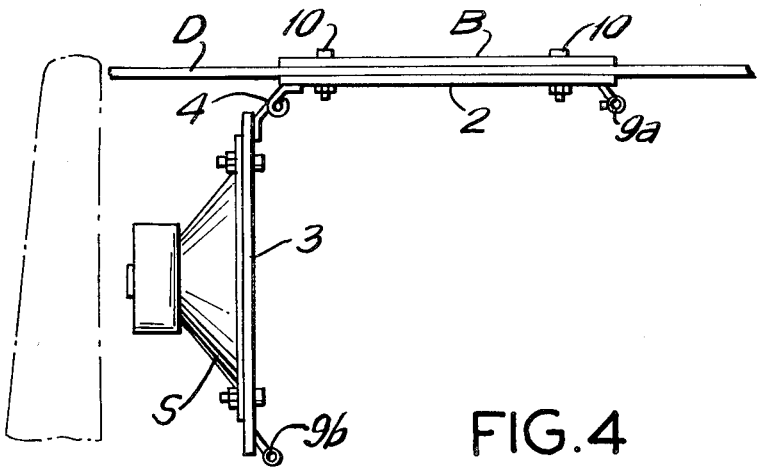
FIG. 4 is a side view of the mounting bracket in the open position when mounted in place.

When it is desired to make the speakers flush top mounted, one may mount the speaker as shown in FIG. 5 in the top of frame 3 so that the top of the speaker S is disposed closer to frame 2 and thereby deck D.

It should also be clear that the mounting bracket according to the present invention can be installed and used in boats where intercabin above deck as well as inside cabin listening is desired. Moreover, the mounting bracket, can be used in indoor and outdoor installations and can be protected from the elements by a plastic housing or the like.

It will be appreciated that the instant specification and claims are set forth by way of illustration and not limitation, and that various modifications and changes may be made without departing from the spirit and scope of the present invention.

What is claimed is:

1. A speaker bracket comprising:

a first planar apertured mounting frame having means for fixedly connecting a speaker thereto with the aperture thereof aligned with the speaker diaphragm;

a second planar apertured mounting frame having means for fixedly connecting same to a planar mounting surface;

means hingedly connecting the two frames together at one edge of each to permit pivotal movement of the two frames from a closed position wherein the two frames are substantially parallel with aligned apertures to an open position wherein the two frames are substantially perpendicular; and means for releasably locking the two frames in the closed position.

2. The speaker bracket according to claim 1, wherein the two frames are rectangular and wherein the releasable locking means includes means disposed along second edges thereof opposite hinged edges.

3. The speaker bracket according to claim 1 or 2, wherein the releasable locking means comprises at least one locking pin, means mounting the pin to one frame for sliding movement parallel to the pivot axis of the frames between a locking position and an unlocking position and at least one locking member mounted on the other frame and receptive of the pin when the frames are in the closed position and when the pin is moved into the locking position.

4. The speaker bracket according to claim 3, wherein the mounting comprises two spaced apart cylindrical collars and wherein the pin has a projection thereon disposed between the two collars to enable movement thereof while preventing removal of the pin.

5. The speaker bracket according to claim 1, wherein each of the two frames comprise integral metal members.

* * * * *